US008640618B2

(12) United States Patent
Takahata

(10) Patent No.: US 8,640,618 B2
(45) Date of Patent: Feb. 4, 2014

(54) PRINTING APPARATUS

(75) Inventor: Kazuaki Takahata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 13/396,957

(22) Filed: Feb. 15, 2012

(65) Prior Publication Data

US 2012/0212537 A1 Aug. 23, 2012

(30) Foreign Application Priority Data

Feb. 22, 2011 (JP) ..... 2011-035801

(51) Int. Cl.
*B41F 23/04* (2006.01)

(52) U.S. Cl.
USPC ..... 101/487; 347/223; 347/102

(58) Field of Classification Search
USPC ..... 347/102, 223; 101/487
See application file for complete search history.

(56) References Cited

U.S. PATENT DOCUMENTS 7,159,518 B2 * 1/2007 Haas et al. ..... 101/487
2003/0029342 A1 * 2/2003 De Vroome ..... 101/487

FOREIGN PATENT DOCUMENTS

JP 2003-326680 A 11/2003

* cited by examiner

*Primary Examiner* — Lam S Nguyen
(74) *Attorney, Agent, or Firm* — Fitzpatrick, Cella, Harper & Scinto

(57) ABSTRACT

A printing apparatus allows a print medium to be heated to a temperature equal to or higher than a condensation temperature of a refrigerant when the print medium is heated during a condensation process of a heat pump. The printing apparatus includes a heating unit for heating a print medium, and a conveying unit for conveying the print medium which has been heated by the heating unit. The heating unit includes a heat-pump mechanism. The heating unit heats the print medium by transferring heat generated by a condenser when the refrigerant is condensed by the condenser. The refrigerant flows along a conveying direction in which the print medium is conveyed by the conveying unit, and flows into the condenser at a downstream side thereof in the conveying direction and out from the condenser at an upstream side thereof in the conveying direction.

5 Claims, 13 Drawing Sheets

PRINTING APPARATUS

BACKGROUND OF THE INVENTION

1. Field of the Invention

The present invention relates to a printing apparatus with heating unit for heating printed print media.

2. Description of the Related Art

In image formation based on ink jet printing, an image is formed on a print medium by ejecting ink onto the print medium. When printing is performed according to such an ink jet method at high speed, immediately after a printed print medium is placed at a sheet discharging position, the next printed print medium may reach the sheet discharging position. This precludes a sufficient time to dry the print medium and to provide dry ink on the print medium. Thus, a printed image portion of the first printed print medium may come into contact with the second printed print medium. Furthermore, when a printed print medium is laid on top of a preceding printed print medium immediately after the preceding printed print medium has been discharged, ink may adhere to the back side of the printed print medium laid on the preceding printed print medium. As a result, the quality of printed matter may be degraded. Thus, to dry and fix the ink in a short time, a printing apparatus is used which includes a mechanism for heating and drying printed print media.

Japanese Patent Laid-Open No. 2003-326680 discloses a fixing device with a preheater and a heater. In the fixing device, each of the preheater and the heater is divided into a plurality of heaters so that heaters corresponding to areas of a printed print medium with images formed therein are activated based on image information in the printed print medium. This procedure reduces the consumption of energy in the fixing device for fixing images and drying print media.

In general, a heating resistor, a halogen heater, a dielectric heating system, or the like is adopted as a heating source for heating printed print media. However, if such a heating source is used, for example, Joule heat generated by current is utilized. However, a conversion of current into heat is likely to result in a loss. Hence, in general, electric energy generated by current is not very efficiently converted into heat energy, leading to a relatively low heat efficiency of the heating source.

Thus, the fixing device for heating and fixing printed images may adopt a thermal conversion device that utilizes a vapor-compression refrigeration cycle with a heat-pump function. The use of such a fixing device allows heat recovered from surroundings to be supplied to a refrigerant, which concurrently functions as a heating source. The thermal conversion efficiency of the fixing device is thus improved. This reduces the energy consumed when printed print media are heated.

If a heat pump is utilized in a heating and drying device for print media as a heating source, heat dissipated during a refrigerant-condensation process is generally utilized to heat the print media. However, when a condenser is used to carryout thermal conversion between the refrigerant and a print medium to be heated, even if the refrigerant is superheated steam with a temperature higher than the condensation temperature, heat is exchanged between the refrigerant and the print medium to immediately lower the temperature of the refrigerant down to the condensation temperature. Thus, when the print medium is heated during the refrigerant-condensation process, once the temperature of the refrigerant reaches the condensation temperature, the print medium and the refrigerant have an equal temperature. This precludes the temperature of the print medium from being further increased. As described above, the heat of the superheated steam cannot be effectively used, and thermal efficiency is thus insufficient. This leads to extra driving of a compressor and the possible consumption of extra power.

Furthermore, the print medium cannot obtain a sufficient amount of heat dissipated from the condenser. Thus, the maintenance of such a state for a long time results in insufficient heat dissipation from the condenser. As a result, the refrigerant is decompressed in the condenser without being supercooled. This prevents a stable refrigeration cycle from being maintained, and increases the operating pressure of the compressor. The operating pressure and power consumption of the compressor are in an almost proportional relationship, and the heat pump thus consumes increased power.

SUMMARY OF THE INVENTION

Thus, in view of the above-described circumstances, an object of the present invention is to provide a printing apparatus that can heat a print medium using a heat pump with less power consumption.

According to an aspect of the present invention, there is provided a printing apparatus comprising: a print head configured to eject ink onto a print medium; a heating unit for heating the print medium onto which the print head has ejected ink, the heating unit includes a heat-pump mechanism with a channel through which a refrigerant passes, and a conveying unit for conveying the print medium downstream along a conveying direction, wherein the heat-pump mechanism comprises a compressor, a condenser, an expansion valve, and an evaporator each provided along the channel, the heating unit heating the print medium by transferring heat generated by the condenser when the refrigerant is condensed by the condenser, and the refrigerant in the channel flowing into the condenser at a downstream side in the conveying direction and out from the condenser at an upstream side in the conveying direction.

According to the present invention, a print medium is heated utilizing the heat quantity of hotter superheated steam and can thus be heated to a higher temperature. This enables the print medium to be heated in a short time. Furthermore, the insufficiency of heat dissipation from a condenser can be reduced to allow a stable refrigeration cycle to be maintained. Thus, the power consumption of a heat pump can be reduced to allow an energy saving effect to be improved.

Further features of the present invention will become apparent from the following description of exemplary embodiments (with reference to the attached drawings).

DESCRIPTION OF THE EMBODIMENTS

Preferred embodiments of the present invention will be described below with reference to the drawings. However, components described in the embodiments below are only illustrative and are not intended to limit the scope of the preset invention thereto.

(First Embodiment)

Figure 1:
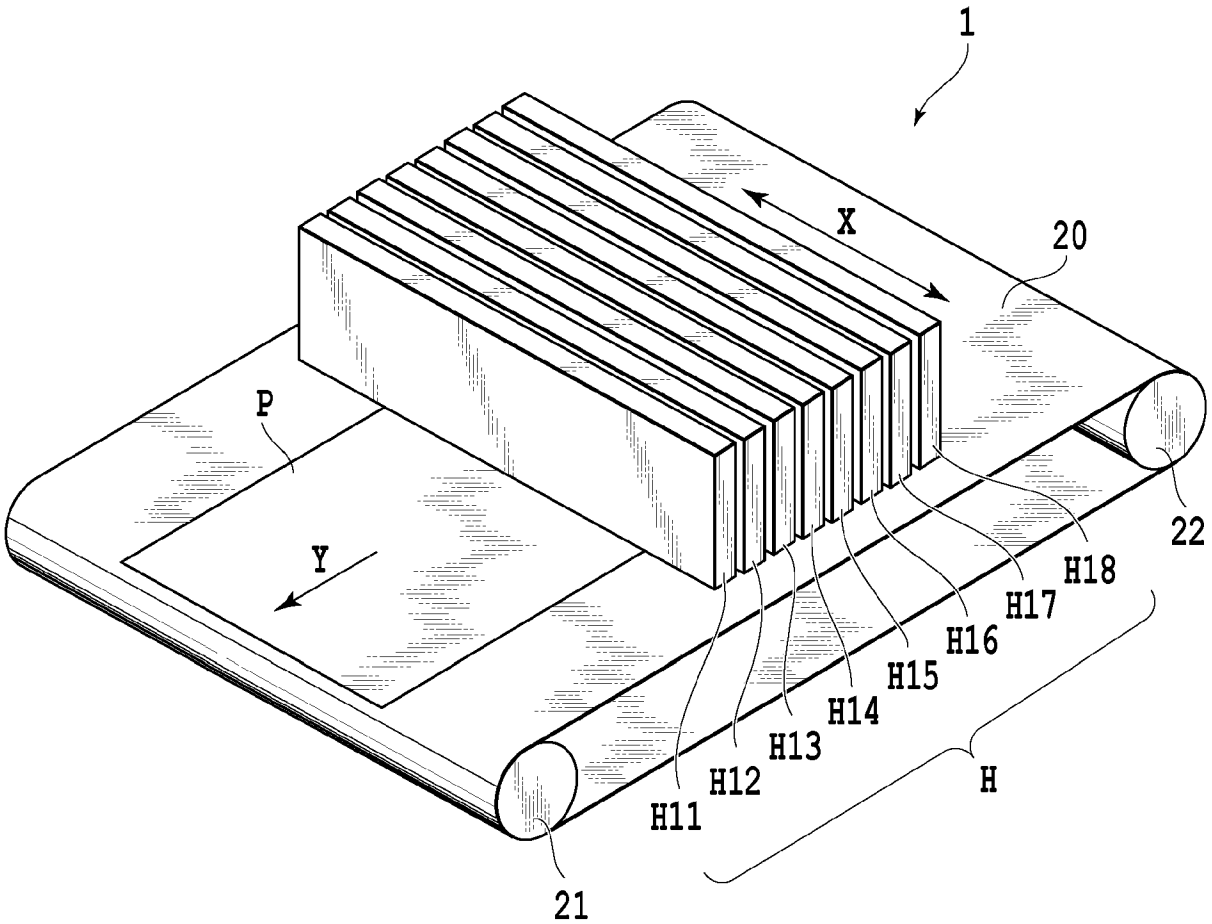
FIG. 1 is a perspective view schematically showing essential parts of an ink jet printing apparatus according to a first embodiment of the present invention.

FIG. 1 is a perspective view schematically showing an example of a full-line ink jet printing apparatus applied to an embodiment of the present invention. An ink jet printing apparatus 1 includes a plurality of elongate print heads H11 to H18, each with a plurality of ejection portions (hereinafter referred to as nozzles) arranged in array configured to eject ink; the print heads H11 to H18 correspond to plural types of inks in the respective colors. Furthermore, an endless conveying belt 20 serving as a conveying section for conveying a print medium P is provided in a direction crossing an x direction that is a longitudinal direction of the print heads (direction along which the ejection port array is extended). The conveying belt 20 is passed around two rollers 21 and 22. When one of the rollers is continuously rotated by a driving motor (not shown in the drawings), the conveying belt 20 moves cyclically to continuously convey the print medium in a Y direction.

Furthermore, in the present embodiment, the inkjet printing apparatus 1 ejects a cyan (C) ink, a magenta (M) ink, a yellow (Y) ink, and a black (Bk) ink to form a color image. Two print heads are provided for each ink color. That is, in FIG. 1, H11 and H12 denote two print heads ejecting cyan ink, and H13 and H14 denote two print heads ejecting magenta ink. Additionally, H15 and H16 denote two print heads ejecting yellow ink, and H17 and H18 denote two print heads ejecting black ink. In the description below, if the print heads need not particularly be distinguished from one another, the print heads may be collectively denoted by reference character H.

In the ink jet printing apparatus described below, the print medium P is fed onto the conveying belt 20 by a sheet feeding mechanism (not shown in the drawings). At this time, printing is performed by the print head H allowing a driver (not shown in the drawings) to selectively drive ejection-energy generation elements to selectively eject ink droplets through ejection ports. The operations of the conveying mechanism, the driver, and the print heads H11 to H18 are controlled by a CPU in a control system. That is, the print heads H11 to H18 eject ink through nozzles based on ejection data transmitted by the control system, while the conveying belt 20 simultaneously conveys the print medium P in synchronism with an ink ejection operation of the print heads H11 to H18. The operation of conveying the print medium P and the ink ejection operation allow an image to be printed on the print medium P. The print heads H11 to H18 can form a color image by ejecting plural types of inks in the different colors onto the print medium. Specific examples of the ejection-energy generation element include a piezo element, a heating element, an electrostatic element, and a MEMS element. If printing is performed by a full-line ink jet printing apparatus as in the present embodiment, nozzles are preferably densely arranged. Thus, the present embodiment uses electrothermal transducing elements that can be densely packaged easily.

Figure 2:
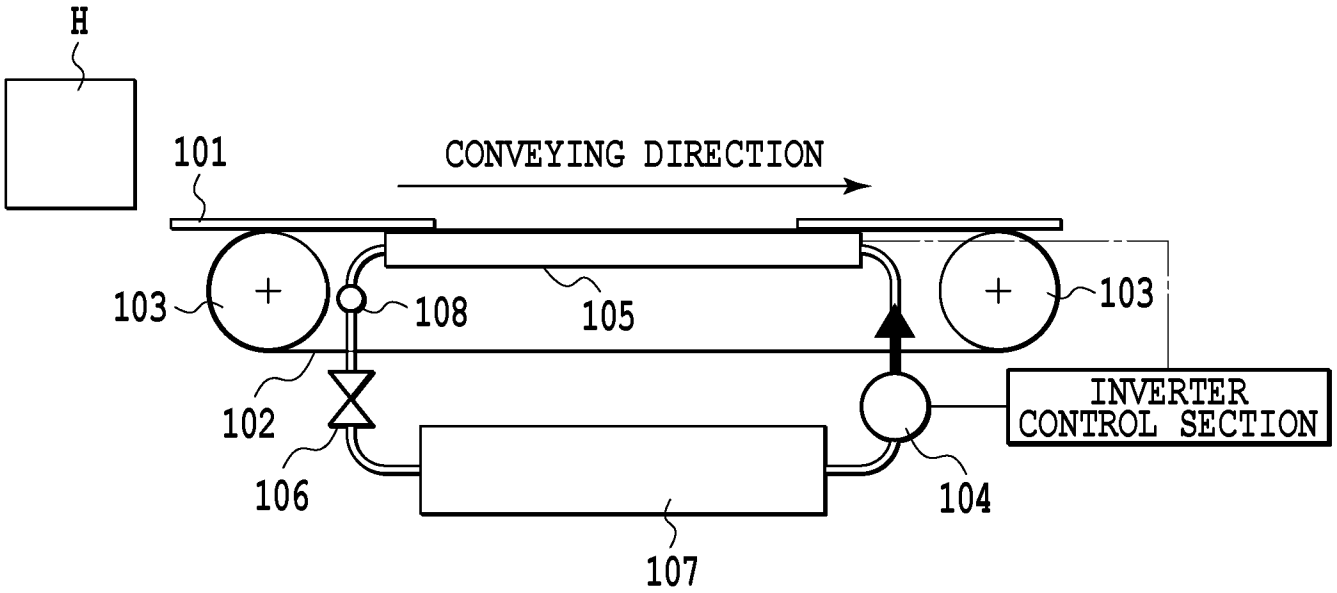
FIG. 2 is a cross-sectional view schematically showing a heating unit for heating a print medium printed by the ink jet printing apparatus in FIG. 1.

FIG. 2 is a schematic cross-sectional view of the configuration of heating and drying unit for the print medium that includes a heating section for the print medium and conveying unit for the print medium according to the present invention. The conveying unit for the print medium includes a conveying belt 102 and a conveying roller 103 as shown in FIG. 2. Furthermore, the ink jet printing apparatus according to the present embodiment includes a heat-pump mechanism operated according to a vapor-compression refrigeration cycle. The heating unit for heating the print medium according to the present embodiment utilizes the heat-pump mechanism to heat the print medium. The heating section of the heating unit includes a compressor (compression unit) 104, a condenser (condensation unit) 105, an expansion valve (expansion unit) 106, and an evaporator (evaporation unit) 107.

The principle of heating according to the present invention will be explained wherein the print medium is heated using, as a heating source, the heat pump for the vapor-compression refrigeration cycle in the print medium drying device used for the inkjet printing apparatus according to the first embodiment.

The heating section includes the compressor 104, the condenser 105, the expansion valve 106, the evaporator 107, a pressure gauge 108, a fan (not shown in the drawings), and an inverter controller. Furthermore, the condenser 105 includes a temperature sensor (not shown in the drawings) that measures temperature. A refrigerant used is a common alternative for chlorofluorocarbon (hydrofluorocarbon). The pressure gauge 108 allows the pressure of the refrigerant in the condenser 105 to be determined, also serving to determine the corresponding condensation temperature. The inverter controller can be used to adjust frequency to between 30 Hz and 75 Hz to vary the number of rotations of the compressor 104, allowing the amount of circulation of the refrigerant to be controlled. This enables the amount of heat dissipated by the condenser 105 to be adjusted. A fan is attached to the evaporator 107 to allow heat to be very efficiently recovered from the surroundings of the evaporator 107. The condenser 105 is attached to the underside of the conveying belt 102, which is attached to the conveying belt 102 in tight contact with the condenser 105. A printed print medium 101 exchanges heat with the condenser 105 via the conveying belt 102 and is thus heated.

As described above, the ink jet printing apparatus includes, as heating unit, a temperature-measuring unit for measuring the temperature of a heat-dissipation section of the condenser 105. The ink jet printing apparatus also includes an arithmetic unit for determining the number of rotations of a motor (compression unit driving motor) that drives the compressor 104 so that the temperature of the heat-dissipation section measured at a downstream side in conveying direction of the print medium is equal to or higher than the condensation temperature of the refrigerant. The ink jet printing apparatus includes a control unit for controlling the number of rotations of the motor for driving the compressor 104. In the present embodiment, the CPU of the ink jet printing apparatus functions as an arithmetic unit and a control unit.

Figure 3:
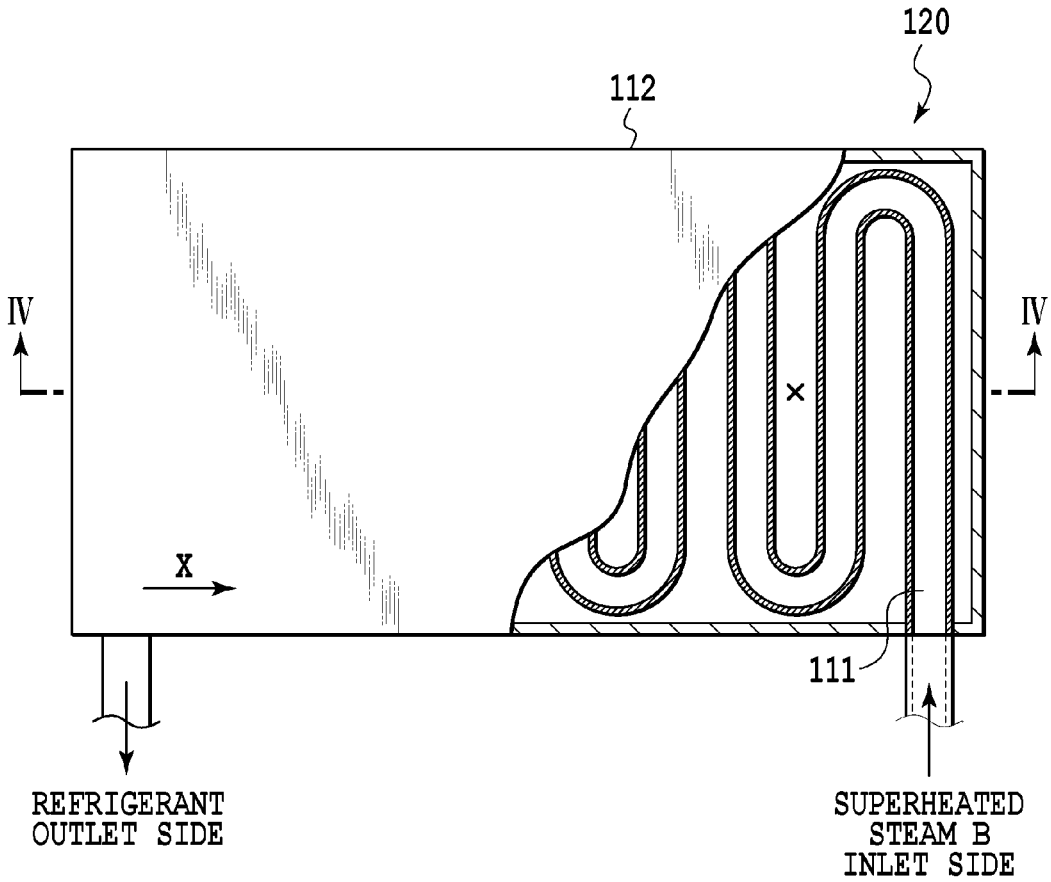
FIG. 3 is an enlarged plan view showing a condenser in the heating unit in FIG. 2.
Figure 4:
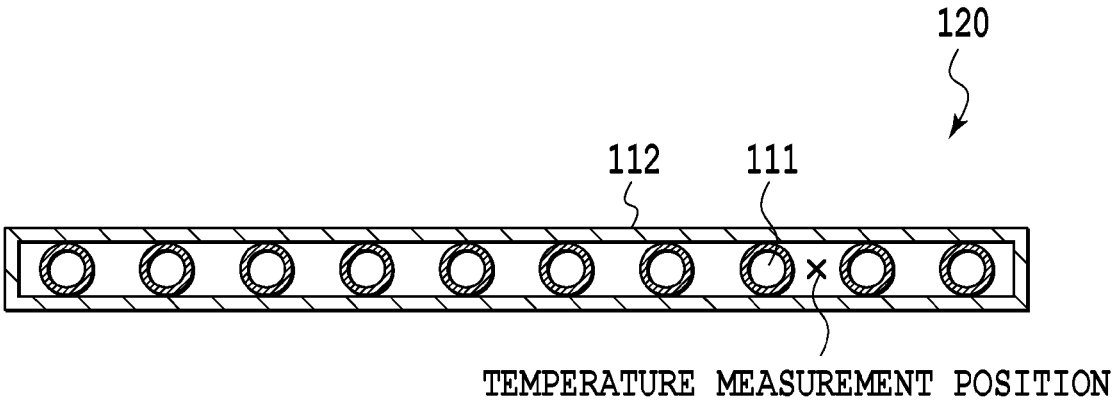
FIG. 4 is a cross-sectional view of the condenser in FIG. 3 taken along line IV-IV.

FIG. 3 is a plan view showing a part of a channel for the refrigerant and in which a surface of the condenser 105, which is subjected to heat exchange, is seen from above. FIG. 4 is a cross-sectional view taken along line IV-IV in FIG. 3. The condenser 105 includes a rectangular parallelepiped-shaped heat sink 120 formed of an aluminum plate 112 and in which a copper pipe 111 is arranged so as to meander. The arrangement of the copper pipe 111 is not limited to the arrangement shown in FIG. 3, but may be another one. The contact area between the copper pipe 111 and the aluminum plate 112 is preferably large. The efficiency of the heat exchange between the refrigerant and the aluminum plate 112 increases consistently with the size of the contact area. The aluminum plate 112 and the copper pipe 111 are processed so as to tightly contact each other in order to improve heat conductivity. Furthermore, the copper pipe 111 is subjected to adiabatic treatment from the compressor 104 to a superheated steam B inlet side to prevent the heat quantity of the superheated steam B from being dissipated to the surroundings. A surface of the aluminum plate 112 which contacts the conveying belt 102 is so smooth as to enhance the tight contact with the conveying belt 102. The surface is plated with, for example, Ti so as to reduce wear caused by friction. On the other hand, the back and side surfaces of the aluminum plate 112 are subjected to adiabatic treatment so as to prevent heat dissipation to components other than the conveying belt 102. Furthermore, a temperature sensor is attached to a central portion of the heat sink 120 in a sheet width direction near the superheated steam B inlet side.

Figure 5:
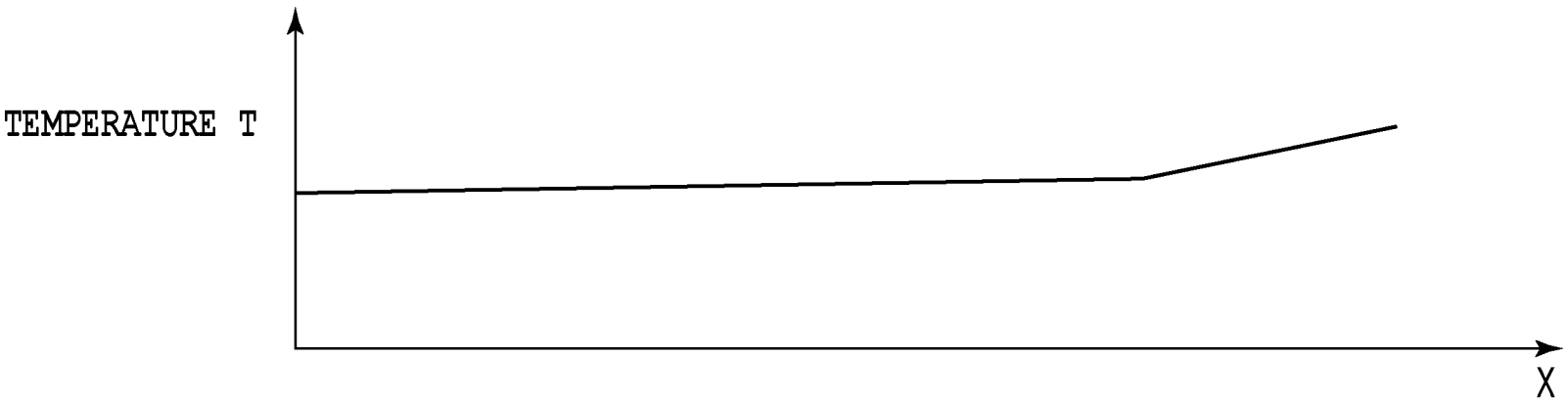
FIG. 5 is a graph showing a temperature distribution in a heat sink in an x direction in the condenser in FIG. 3.

The refrigerant is compressed by the compressor 104 to a pressure equal to or higher than a saturated vapor pressure for a desired temperature, and becomes superheated steam B. The refrigerant, remaining the superheated steam B, is then condensed while flowing through the copper pipe 111 arranged so as to meander from the inlet side. The refrigerant finally reaches an outlet side of the heat sink 120. During this process, the surface of the heat sink 120 containing the copper pipe 111, through which the refrigerant, changed into the superheated steam, has a surface temperature equal to or higher than the condensation temperature of the refrigerant. Hence, the temperature distribution of a heat-dissipation surface that is the contact surface between the heat sink 120 and the belt is such that the temperature of the heat-dissipation surface increases in the x direction shown in FIG. 3. FIG. 5 shows an example of the current temperature distribution of the heat-dissipation surface of the heat sink 120 of the condenser 105.

Furthermore, the conveying unit shown in FIG. 2 includes a suction mechanism (not shown in the drawings) for bringing the print medium 101 into tight contact with the conveying belt 102 by suction. Small holes are formed in the conveying belt 102 so as to bring the print medium 101 into tight contact with the conveying belt 102. Furthermore, the heat sink 120 includes a plurality of air suction holes formed therein to bring the print medium 101 into tight contact with the heat sink 120, and a suction fan arranged under the suction holes. Air is sucked through the air suction holes by the suction fan to bring the print medium 101 into tight contact with the conveying belt 102. The print medium in tight contact with the conveying belt 102 is then conveyed on the heat sink.

The method for bringing the print medium 101 into tight contact with the conveying belt 102 is not limited to that in which a suction mechanism brings the print medium 101 into tight contact with the conveying belt 102. An electrostatic method may be used to bring the print medium 101 into tight contact with the conveying belt 102. In this case, the conveying unit includes a conveying section with a conveying roller 103 around which the conveying belt 102 is wound and a mechanism (not shown in the drawings) for electrostatically bringing the print medium 101 into tight contact with the conveying belt 102. If the print medium is to be electrostatically brought into tight contact with the conveying belt 102, the conveying belt 102 may be formed of multiple layers such that a conductive layer and a release layer (resistive layer) each with a thickness of the order of several pm are sequentially coated on an endless film formed of a polyimide resin and having a thickness of several μm to several tens of μm. In this case, the conductive layer of the conveying belt 102 is electrically grounded (not shown in the drawings). Thus, when charge is applied to between the conductive layer and the release layer, serving as an insulating layer, or the print medium 101, placed on the release layer, the print medium 101 can be electrostatically brought into contact with the conveying belt 102 and conveyed on the heat sink.

Figure 6:
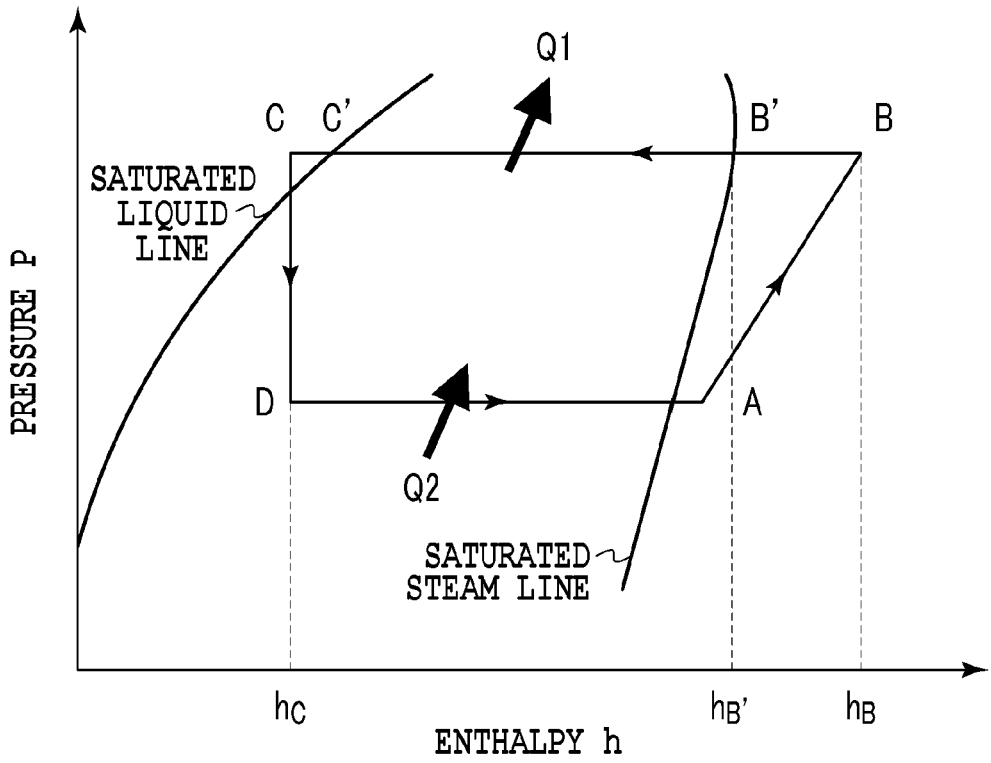
FIG. 6 is a graph showing a cycle in the heating unit in FIG. 2 using the relationship between pressure and enthalpy.

FIG. 6 is a P-h diagram for pressure P and enthalpy h involved in the vapor-compression refrigeration cycle used for the heat pump according to the present embodiment. As shown in the P-h diagram in FIG. 6, the heat-pump mechanism used for the present embodiment allows the compressor 104 to compress superheated steam A in a state A in FIG. 6 to a pressure equal to or higher than the saturated vapor pressure for the desired temperature. The heat-pump mechanism then feeds the resultant superheated steam B in a state B in FIG. 6 to the condenser 105. The superheated steam B fed to the condenser 105 is cooled by the condenser 105 dissipating a heat quantity Q1 and thus liquefied into a supercooled liquid C represented by a state C in FIG. 6. The supercooled liquid C is fed to the expansion valve 106, which carries out isenthalpic expansion to change the liquid into wet steam D represented by a state D in FIG. 6. The wet steam D is then fed to the evaporator 107. The wet steam D fed to the evaporator 107 obtains a heat quantity Q2 from the surroundings to become superheated steam A. The superheated steam A is then fed to the compressor 104 again to allow a thermal cycle to be repeated.

Figure 7:
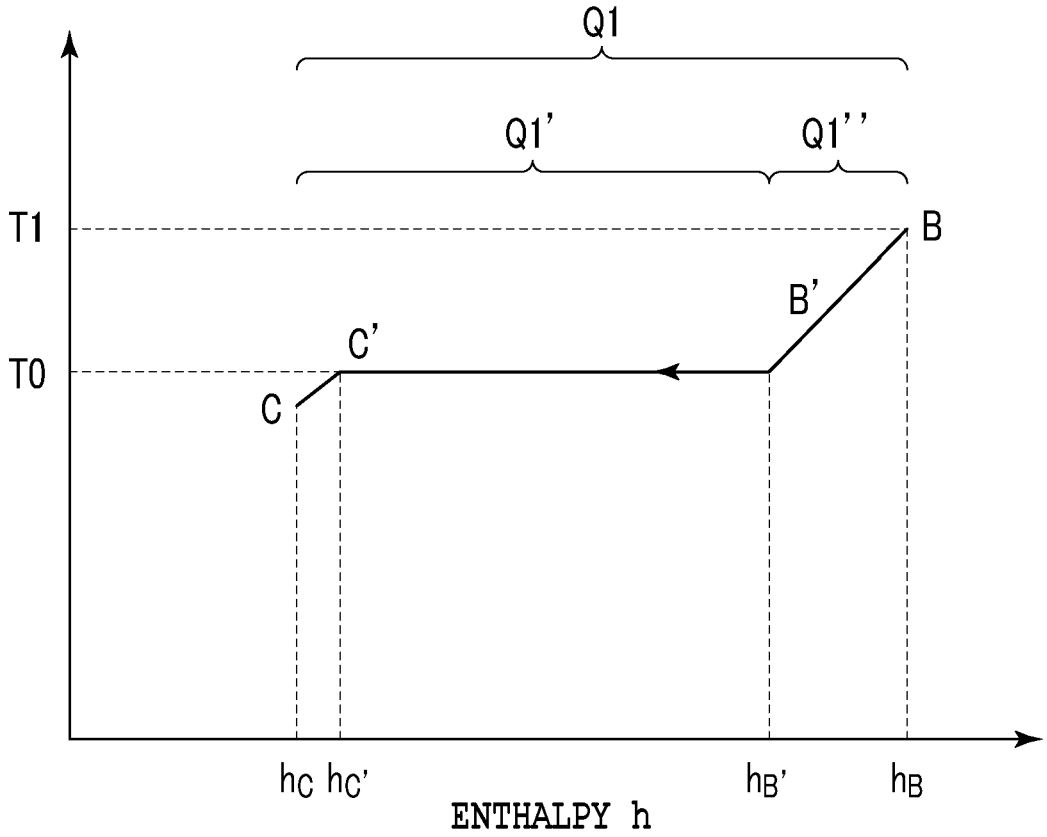
FIG. 7 is a graph showing a variation in temperature when a refrigerant shifts from a state B to a state C as shown in the graph in FIG. 6 illustrating the relationship between pressure and enthalpy, the variation being shown using the relationship between temperature and enthalpy.

When the print medium is heated, heat is exchanged between the condenser 105 and the print medium, which is heated by heat dissipated to the exterior of the condenser 105. A heat quantity will be described which is dissipated by the condenser 105 when heat is exchanged between the condenser 105 and the print medium. FIG. 7 illustrates the relationship between temperature and enthalpy changes for the heat quantity Q1 dissipated by the condenser 105. In a sensible heat change where the state of the superheated steam changes from B to B', the enthalpy changes from $h_B$ to $h_{B'}$ with the temperature decreasing. During a process from the state B' to a state C', where condensation is occurring as shown in FIG. 7, the latent heat is dissipated, changing the enthalpy from $h_{B'}$ to $h_C$ with the temperature unchanged. In a sensible heat change where the state changes from the state C' to the state C, where supercooling is occurring, the enthalpy changes from $h_{C'}$ to $h_C$ with the temperature decreasing. Furthermore, a heat quantity dissipated from the refrigerant to the exterior during a process from the superheated steam B in the state B to the superheated steam B' in the state B' as shown in FIG. 7 is denoted by Q1". A heat quantity dissipated from the refrigerant to the exterior when the enthalpy changes from $h_{B'}$ to $h_{C'}$ is denoted by Q1".

In the present embodiment, when heat is exchanged between the print medium and the condenser 105, the print medium 101 is conveyed by the conveying unit from the refrigerant-outlet side through which the refrigerant flows out from the condenser 105 toward the refrigerant-inlet side through which the refrigerant flows into the condenser 105. That is, the refrigerant flows along the conveying direction in which the print medium 101 is conveyed by the conveying unit, into the condenser 105 at the downstream side in the conveying direction of the print medium. Furthermore, the refrigerant flows out from the condenser 105 at an upstream side in the conveying direction of the print medium. Thus, the print medium is first heated at the refrigerant-outlet side of the condenser 105 to have the temperature thereof sufficiently raised. Then, at the refrigerant-inlet side of the condenser 105, through which the refrigerant flows into the condenser 105, heat is exchanged between the print medium and the condenser 105. The refrigerant-outlet side of the condenser 105, through which the refrigerant flows out from the condenser 105, the temperature of the refrigerant is close to the condensation temperature T0. Thus, the temperature of the print medium 101 rises nearly to T0. The print medium 101 is thereafter conveyed to the refrigerant-inlet side of the condenser 105, through which the refrigerant flows into the condenser 105, where heat is exchanged between the print medium 101 and the condenser 105. At this time, the temperature of the print medium 101 has already risen nearly to the condensation temperature TO of the refrigerant. Hence, even though the print medium 101 comes into contact with the condenser 105 when heat is exchanged between the print medium 101 and the condenser 105, a possible decrease in the temperature of the condenser 105 can be reduced.

Consequently, when the print medium is heated utilizing the heat quantity Q1 from the condenser 105, the heat quantity Q1' ($h_{B'} \rightarrow h_{C}$) during a latent heat change with a relatively significant enthalpy change ($h_{B'} \rightarrow h_{C'}$) and a sensible heat change during supercooling ($h_{C'} \rightarrow h_{C}$) is used for the heating. Thus, first, the temperature of the print medium is increased nearly to the condensation temperature TO of the refrigerant. Thereafter, heat is further exchanged between the condenser and the print medium by the heat quantity Q1" resulting from the heat dissipation during an enthalpy change caused by a change in the sensible heat ($h_{B} \rightarrow h_{B'}$) of the superheated steam. This increases the temperature of the print medium from the condensation temperature T0 nearly to a temperature T1 higher than the condensation temperature T0.

As described above, when the print medium 101 exchanges heat with the condenser 105, the heat exchange is performed while print medium 101 being conveyed from the refrigerant-outlet side to refrigerant-inlet side of the condenser 105. This restrains the print medium 101 from coming into contact with the refrigerant-inlet side of the condenser 105 while the print medium is cold and thus from reducing the temperature of the refrigerant. Consequently, after the print medium is heated nearly to the condensation temperature T0 of the refrigerant, hot superheated steam at the inlet side of the condenser 105 can be used to raise the temperature of the print medium nearly to the temperature T1, which is higher than the condensation temperature T0. As described above, in the present embodiment, the print medium 101 is conveyed from the refrigerant-outlet side toward refrigerant-inlet side of the condenser 105 and thus gradually heated. The sensible heat of the refrigerant can thus be effectively utilized. The thermal efficiency of drying of the print medium can therefore be further improved. Furthermore, in this case, the thermal capacity of the print medium 101 is relatively small, allowing the temperature of the print medium 101 to be sufficiently raised even with the heat quantity Q1" of superheated steam with a relatively insignificant enthalpy change. The temperature of the print medium 101 can thus be increased to T1, which is higher than the condensation temperature T0.

A change in the temperature of the print medium will be described in which the temperature is raised by heat dissipation caused by a change in the sensible heat of superheated steam. As shown in FIG. 6 and FIG. 7, when the heat quantity Q1 is dissipated, the enthalpy of the refrigerant changes from $h_B$ to $h_C$. In this case, in the sensible heat, the enthalpy of the refrigerant of superheated steam changes from $h_B$ to $h_{B'}$. With regard to the ratio of enthalpy changes, the heat quantity Q1" dissipated by a change in the sensible heat of the refrigerant is about 20% of the total heat quantity Q1 dissipated during the condensation of the refrigerant. With regard to the capabilities of the heat pump, if Q1 is expected to correspond to about 2,500 W, the heat dissipated by a change in the sensible heat of the superheated steam corresponds to about 500 W.

Figure 8:
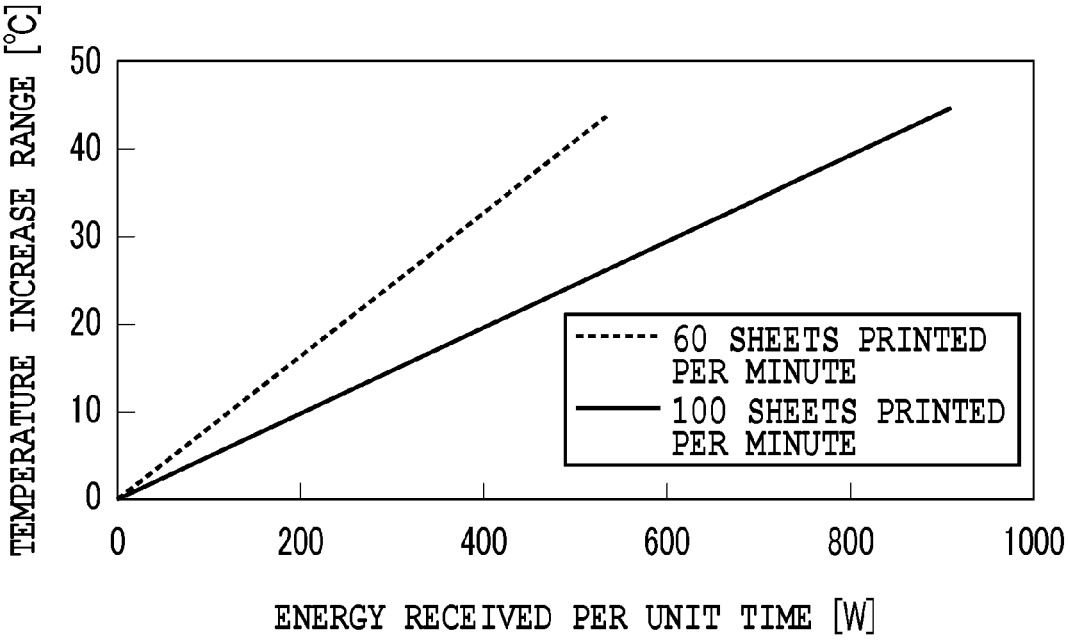
FIG. 8 is a graph showing the relationship between energy received by the refrigerant and the range of an increase in the temperature of the refrigerant depending on energy, in connection with changes in the refrigerant in the condenser in FIG. 3.

FIG. 8 shows an example of the results of calculations of energy received from the condenser by a printed print medium per unit time as well as the range of a corresponding increase in temperature. Here, 100% duty printing is performed on print media that are A4-sized plain paper of basis weight 105 g/m$^2$, at intervals of 1,200 dpi using ink droplets each of 4 pl. FIG. 8 shows the range of an increase in the temperature of the print medium conveyed at a conveying speed at which 60 print media are printed per minute under the above-described conditions, and the range of an increase in the temperature of the print medium conveyed at a conveying speed at which 100 print media are printed per minute under the above-described conditions. The figure shows the range of an increase in the temperature of the print medium heated upon receiving the 500-W energy of the heat quantity Q1" of sensible heat per unit time with a temperature equal to or higher than the condensation temperature. In this case, as shown in FIG. 8, when the print medium is conveyed at the conveying speed at which 60 print media are printed per minute, the temperature of the print medium can be computationally increased by about 40° C. when the print medium receives the 500-W energy. Furthermore, when the print medium is conveyed at the conveying speed at which 100 print media are printed per minute, the temperature of the print medium can be computationally increased by about 25° C. However, part of the energy is uselessly consumed as a result of a loss during heat exchange or evaporation of moisture from ink associated with a rise in the temperature of the print medium. Thus, not all of the 500-W energy of Q1" can be utilized for a temperature increase. As a result, the resultant temperature is lower than the one calculated above. However, when the temperature of the print medium is increased utilizing the heat quantity of the superheated steam, the thermal efficiency of heating of the print medium can further be improved. Therefore, the speed at which ink is dried can be increased, with the power consumption reduced.

Figure 9:
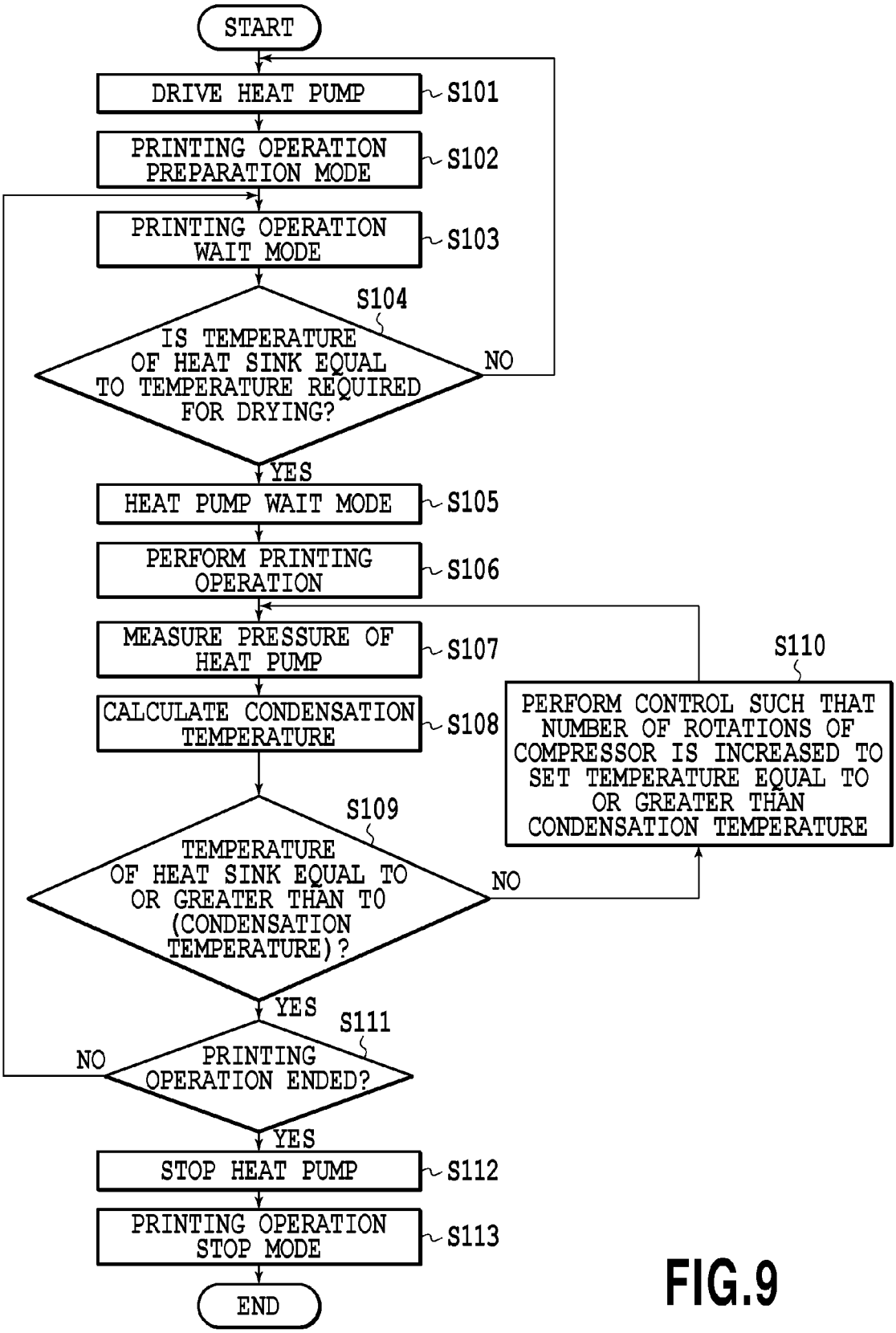
FIG. 9 is a flowchart showing the control steps performed when a print medium is heated by the heating unit in FIG. 2.

FIG. 9 is a flowchart of heating of the print medium using the heat-pump mechanism according to the present embodiment. The steps of heating of the print medium using the heat-pump mechanism according to the present embodiment will be described with reference to FIG. 9. When the process of heating of the print medium using the heat-pump mechanism starts, the compressor 104 in the heating section in the heat pump is driven to start warming up the heat sink 120 of the condenser 105 (step S101). At the same time, a recovery operation that needs to be performed before ejection of ink from the print heads is started, and preparation of a printing operation is started (step S102). After the preparation of a printing operation ends, a standby mode lasts until output image information is received (step S103). During the standby mode, warm-up of the heat sink 120 of the condenser 105 is started, and at the same time, the temperature detection unit measures the temperature of the heat sink 120. The apparatus determines whether the temperature of the heat sink 120 has reached a value required to dry the printed surface of the print medium (step S104).

If the temperature of the heat sink 120 of the condenser 105 has not reached the value required to dry the printed surface of the print medium, the condenser 105 continues the warm-up. Then, when the temperature of the heat sink 120 in the condenser 105 reaches the heating temperature, the heat-pump mechanism shifts to the standby mode (step S105). In the standby mode (step S105), the number of rotations of the compressor is maintained at a value required to keep the temperature of the heat sink 120, provided in the condenser 105, at a heating temperature required for drying. Thereafter, image information is transmitted to the ink jet printing apparatus, which performs a printing operation (step S106). Then, the pressure gauge 108 in the heat pump in the heating section measures the pressure (step S107).

Then, based on the pressure measured by the pressure gauge 108, the condensation temperature of the refrigerant is calculated (step S108) according to the P-h diagram shown in FIG. 2. The temperature detection unit in the heat sink 120, provided in the condenser 105, measures the temperature of the heat sink 120, provided in the condenser 105. The apparatus then compares the measured temperature with the temperature calculated in step S108 to determine whether the temperature of the heat sink of the condenser 105 is equal to or higher than the condensation temperature of the refrigerant (step S109). If the temperature of the heat sink of the condenser 105 is not equal to or higher than the condensation temperature of the refrigerant, the inverter control section controllably increases the frequency of the compressor and thus the number of rotations (step S110). An increase in the number of rotations increases the amount of refrigerant circulated and the amount of heat dissipated by the heat sink 120 of the condenser 105. If the temperature of the heat sink is equal to or higher than the condensation temperature, the apparatus determines whether the printing operation is to be ended (step S111). If the printing operation is to be continued instead of being ended, the process returns to step S103 to repeat S103 to S111 until the printing operation is ended. To end the printing operation, the heat pump is stopped (step S112), and the power supply is stopped to stop the printing operation performed by the ink jet printing apparatus (step S113).

The heating and drying unit for the print medium including the above-described heating section heats the printed print medium 101 being conveyed, by means of heat exchange with the heat sink 120, provided in the condenser 105. The printed print medium 101 is conveyed from the refrigerant-outlet side, corresponding to the low-temperature side of the copper pipe 111 in the heat sink 120 of the condenser 105, to the inlet side for the superheated steam B, corresponding to the high-temperature side. The print medium 101 can thus be heated up to and above the condensation temperature of the refrigerant in the heat-pump mechanism. This enables an increase in the speed at which ink is dried.

Specific effects of heating of the print medium by the heat-pump mechanism according to the present embodiment will be described below. In the present embodiment, the heat-dissipation surface of the heat sink 120, provided in the condenser 105 of the heat-pump mechanism shown in FIG. 3, is 320 mm×400 mm in size; heat is dissipated through the heat-dissipation surface to the exterior. The heat sink 120 is formed of a hollow box-shaped aluminum plate. The surface of the heat sink through which the heat sink exchanges heat with the print medium is formed to be able to transfer heat. The surface of the heat sink through which the heat sink does not exchange heat with the print medium is formed to be adiabatic. The copper pipe is arranged in the heat sink so as to extend about 5 m in a meandering manner. The refrigerant flows through the copper pipe. The amount of the refrigerant in the heart pump is adjusted such that the temperature of the superheated steam inlet side of the heat-dissipation surface reaches 70° C. in about 120 seconds after actuation of the compressor; this temperature corresponds to the heating temperature required for drying. The refrigerant used is R134a, which is an alternative for chlorofluorocarbon (hydrofluorocarbon).

The compressor 104 in the heat pump was operated at 75 Hz, corresponding to the maximum frequency. After the temperature of the refrigerant-inlet side of the heat-dissipation surface reached 70° C., the temperature of the heat-dissipation surface was maintained with the frequency of the compressor 104 adjusted. Print media printed with ink started to be continuously conveyed at a conveying speed of 400 m/sec. The print medium was passed over the heat sink of waiting condenser 105, maintained at the heating temperature of the print medium, and was thus heated and dried. The print media used were A4-sized plain paper of thickness 100 μm. In this case, the heat-pump mechanism had a power consumption of about 280 W. The pressure gauge 108 for the condenser 105 attached between the condenser 105 and the expansion valve 106 indicated a value of 1.6 MPa. The condensation temperature was about 60° C. Furthermore, the temperature of the heat sink 120, corresponding to the condenser 105, was 68° C. at the refrigerant-inlet side, which was higher than the condensation temperature. As described above, the heat-dissipation surface of the condenser was 400 mm in the conveying direction, and the conveying speed was 400 mm/sec. Thus, the time required to heat the print medium was 1 second.

In the present embodiment, the heating and drying unit for the print medium including the heating section conveys the print medium 101 from the refrigerant-outlet side to refrigerant-inlet side of the heat sink 120 of the condenser 105. At this time, the surface temperature of the print medium 101 heated through the heat-dissipation surface of the condenser 105 increased from 25° C. to 63° C. During conveyance to the vicinity of the central portion of the heat sink of the condenser 105, the print medium 101 was heated by the heat sink 120, corresponding to the condenser 105, to a temperature that is almost the same as the condensation temperature. At the end of the conveyance, corresponding to the vicinity of the refrigerant inlet of the heat sink 120, corresponding to the condenser 105, the temperature of the print medium further rose.

On the other hand, when the print medium 101 was conveyed in the direction opposite to that according to the present embodiment, that is, from the refrigerant-inlet side to refrigerant-outlet side of the heat sink 120 of the condenser 105, the surface temperature of the print medium 101 rose only from 25° C. to 58° C. This is because the heat sink 120 at the refrigerant-inlet side corresponding to an area of the condenser 105 where superheated steam flowed was cooled by the unheated print medium 101. Thus, the superheated steam is cooled to the condensation temperature. When the heat of the superheated steam is dissipated to the print medium, the high temperature cannot be maintained owing to the small thermal capacity of the superheated steam. As a result, the temperature of the heat sink 120 of the condenser 105 decreased to a temperature that is almost the same as the condensation temperature. In the conveying direction of the print medium, the temperature of the heat sink 120 of the condenser 105 decreased to 60° C.

Thus, heat can be more efficiently transferred from the condenser to the print medium when the print medium 101 is conveyed from the refrigerant-outlet side of the heat sink 120 of the condenser 105, which corresponds to the low-temperature side, to the refrigerant-inlet side, which corresponds to the high temperature side. That is, heat can be more efficiently exchange between the condenser and the print medium when the print medium is conveyed from the low-temperature side to high-temperature side of the heat sink 120, corresponding to the condenser 105, that is, in the direction opposite to the circulation direction of the refrigerant in the heat sink. As described above, the present embodiment can raise the temperature to which the print medium 101 is heated by the heat-pump mechanism, without an increase of power consumption, thus reducing the time required to heat the print medium. Consequently, the print medium can be heated in a short time. Furthermore, the present embodiment allows the refrigerant to be efficiently dissipated inside the condenser, thus ensuring heat dissipation by the refrigerant, flowing through the condenser. This enables a reduction in the insufficiency of heat dissipation from the condenser, allowing the refrigeration cycle to be stably operated. The operating pressure of the compressor can thus be reduced. The present embodiment can therefore reduce the power consumed to operate the compressor, decreasing the operating cost of the refrigeration cycle.

(Second Embodiment)

Now, a second embodiment of the present invention will be described. In the figures, components of the second embodiment which are configured as is the case with the first embodiment are denoted by the same reference numerals. The description of these components is omitted, and only different components will be described.

Figure 10:
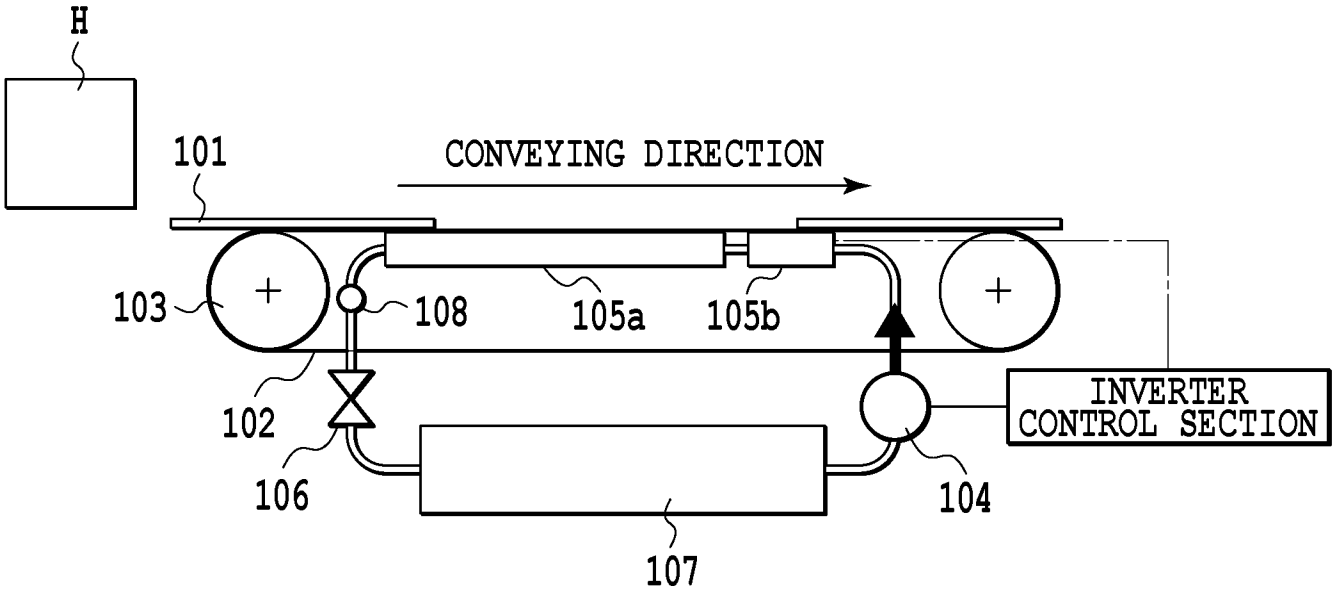
FIG. 10 is a cross-sectional view schematically showing a heating unit provided in the ink jet printing apparatus according to the first embodiment of the present invention to heat a printed print medium.

FIG. 10 is a cross-sectional view schematically showing the configuration of heating and drying unit for heating a print medium 101 printed with ink by print heads in the second embodiment. A heat-pump mechanism according to the second embodiment is different from that according to the first embodiment in that the former heat pump includes two separate condensers 105*a* and 105*b*. In the second embodiment, the condenser 105 is separated into the condenser 105*a* on the refrigerant-outlet side thereof, where a refrigerant changed into wet steam flows out from the condenser, and the condenser 105*b* on the refrigerant-inlet side thereof, where the refrigerant in the form of superheated steam flows into the condenser. The condensers 105*a* and 105*b* include heat sinks 120*a* and 120*b*, respectively.

Figure 11:
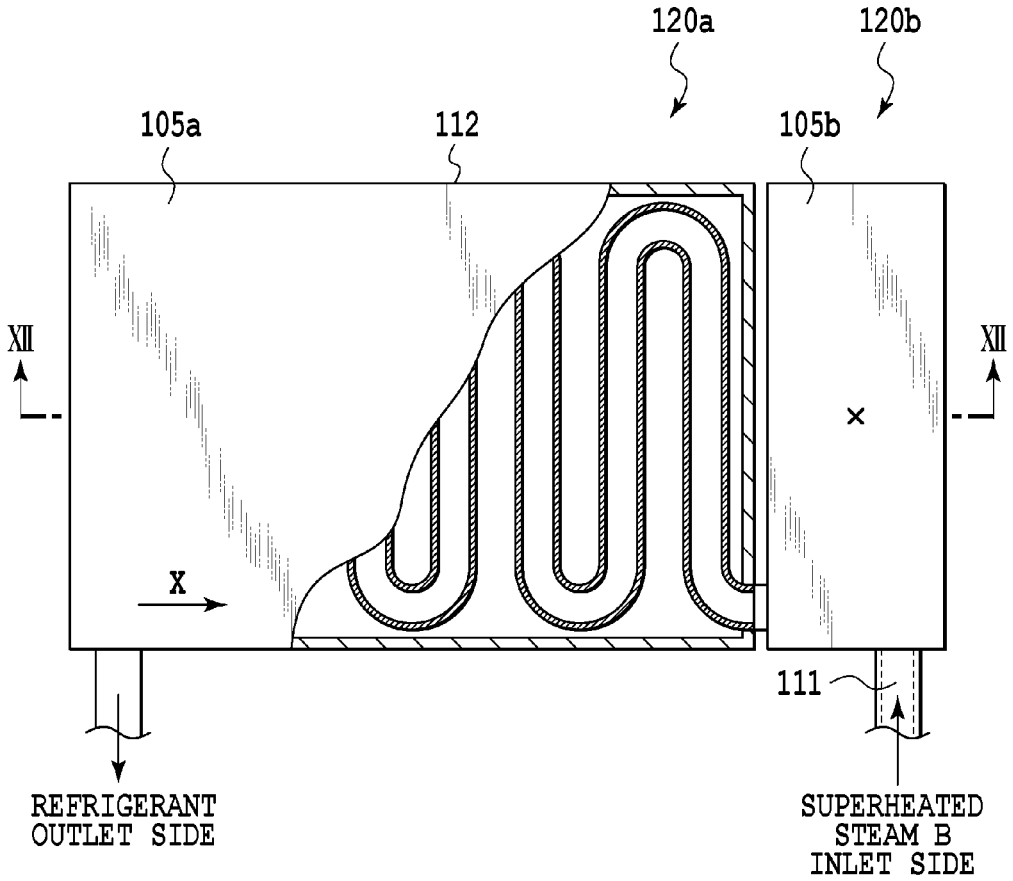
FIG. 11 is an enlarged plan view of the condenser in the heating unit in FIG. 10.
Figure 12:
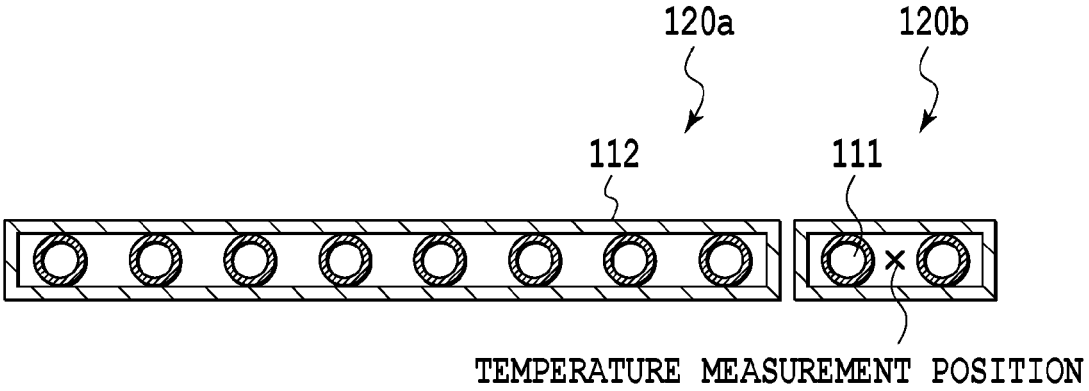
FIG. 12 is a cross-sectional view of the condenser in FIG. 11 taken along line XII-XII.

FIG. 11 is a plan view showing a configuration in which the condenser 105 according to the second embodiment is separated into the refrigerant-inlet side and the refrigerant-outlet side and partly showing a channel for the refrigerant. FIG. 12 is a cross-sectional view taken along line XII-XII in FIG. 11. The condensers 105*a* and 105*b* shown in FIGS. 11 and are similar to the condenser according to the first embodiment except that the heat sink is separated into the heat sink 120*a* on the refrigerant-outlet side and the heat sink 120*b* on the refrigerant-inlet side.

An example of conditions for a position where the condenser is separated into the refrigerant-inlet side and the refrigerant-outlet side will be described with reference to the graphs in FIG. 6 and FIG. 7. When a print medium 101 is heated, during conveyance, by heat exchange with the heat sinks 120*a* and 120*b* of the condenser 105 in FIG. 11, the refrigeration cycle of the heat pump is operated as shown in FIG. 6 and FIG. 7.

The refrigerant entering into the condenser 105*b* flows into the condenser 105*b* and then through the channel for the refrigerant in the condenser 105*b* while shifting from the state of superheated steam B to the state of superheated steam B'. The refrigerant then temporarily flows out from the condenser 105*b*. Thereafter, the refrigerant flows into the condenser 105*a* and shifts from the state of the wet steam B' to the state of supercooled liquid C in the condenser 105*a*. At this time, the print medium 101 is heated by an heat quantity Q1' dissipated through the contact surface between the heat sink 120*a* of the condenser 105*a* and the conveying belt 102 and a heat quantity Q1" dissipated through the contact surface between the heat sink 120*b* of the condenser 105*b* and the conveying belt 102.

In this regard, in the present embodiment, the ratio of the heat quantities Q1' and Q1" dissipated from the respective heat sinks (the ratio of the amounts of enthalpy changes) are preferably set equal to the ratio of the heat-dissipation surface area of the heat sink 120*b* of the condenser 105*b* to the heat-dissipation surface area of the heat sink 120*a* of the condenser 105*a*. The state of heat exchange between the heat sink, corresponding to the condenser 105, and the print medium 101 may be changed by a difference in the print medium or the conveying speed. Then, the refrigeration cycle in FIG. 6 and FIG. 7 may change and thus the ratio of the amounts of heat dissipation (the ratio of the amounts of enthalpy changes) may change. In this case, since the refrigeration cycle shown in FIG. 6 and FIG. 7 is maintained, inverter control unit provided in a compressor 104 may be used to control the number of rotations of the compressor 104 to adjust the amount of the refrigerant circulated. Specifically, the heat-pump mechanism is operated according to the flow shown in FIG. 9 and starting at step S107. In the present embodiment, a temperature detection unit in the condenser is provided at a temperature measurement position in the heat sink 120*b* of the condenser 105*b* in FIG. 12.

As described above, in the present embodiment, the heat sink of the condenser is divided into two portions. Thus, heat is restrained from transferring from the relatively hot heat sink of the condenser on the refrigerant-inlet side to the relatively cold heat sink of the condenser on the refrigerant-outlet side. This suppresses a decrease in the temperature of the relatively hot heat sink of the condenser on the refrigerant-inlet side; the heat sink of the condenser on the refrigerant-inlet side is maintained at the high temperature. Consequently, the temperature of a superheated steam inlet side of the heat sink can be increased, enabling an increase in the temperature of heated print media.

When the Q1' and Q1" dissipated from the heat sinks of the two condensers 105*a* and 105*b* are compared with each other, the sensible heat Q1" of the superheated steam is smaller than the Q1'. Thus, one of the two separate condensers that is located on the downstream side in the conveying direction of the print medium preferably has a smaller thermal capacity than the other condenser located on the upstream side in the conveying direction of the print medium.

As described above, the temperature of the condenser 105*b* on the refrigerant-inlet side can be set higher than the temperature of the refrigerant which is the superheated steam B at the inlet side of the condenser 105 according to the first embodiment. The print medium can thus be heated by the much hotter refrigerant. Consequently, this heating regimen enables the temperature of the print medium 101 to be further raised. An increased amount of heat is exchanged between the print medium 101 and the heat sinks 120*a* and 120*b* of the condensers 105*a* and 105*b*. This allows the print medium to be more efficiently heated. Furthermore, heat can be more reliably dissipated from the heat sinks 120*a* and 120*b* of the condensers 105*a* and 105*b*. This allows the refrigeration cycle to be stably operated, enabling a reduction in the power consumption of the heat pump.

Figure 13:
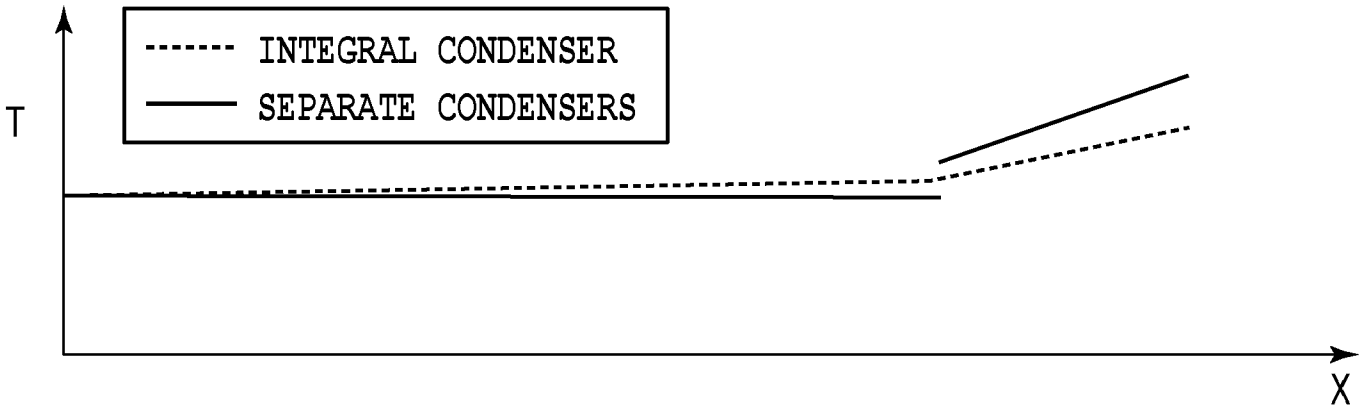
FIG. 13 is a graph showing a temperature distribution in the heat sink in the x direction where the print medium is heated using the condenser in FIG. 11 and a temperature distribution in the heat sink in the x direction where the print medium is heated using an integrated condenser.

FIG. 13 shows the temperature distribution of the heat-dissipation surfaces of the heat sinks 120*a* and 120*b* of the separate condensers 105*a* and 105*b* illustrated in the present embodiment and the temperature distribution of a heat sink of a condenser that is integrally formed as is the case with the first embodiment. The effects of heating of the print medium according to the present embodiment will be described with reference to FIG. 13. In the present embodiment, the heat-dissipation surface of the heat sink 120*b* of the condenser 105*b* was 320 mm×80 mm in size. The heat-dissipation surface of the heat sink 120*a* of the condenser 105*a* was 320 mm×320 mm in size. The heat sinks 120*b* and 120*a* were separated from each other by about 5 mm. A copper plate arranged in the two plates so as to meander was about 5 m in length. The amount of the refrigerant in the heat pump was the same as that in the first embodiment. Furthermore, the steps of a process for heating the print medium according to the present embodiment is the same as that shown in FIG. 9.

In the present embodiment, the heat pump was operated at 75 Hz, corresponding to the maximum frequency of the compressor 104. After the temperature of the heat sink 120*b* of the condenser 105*b* reached 80° C., a heating temperature required for drying, the temperature of the heat-dissipation surface was maintained with the frequency of the compressor 104 adjusted. Print media printed with ink started to be continuously conveyed at a conveying speed of 400 m/sec. The print medium was passed over the waiting heat sink corresponding to the condenser 105 and already adapted for heating, and was thus heated and dried. The print media 101 used were A4-sized plain paper of thickness 100 μm. In this case, the heat-pump mechanism had a power consumption of about 280 W. The pressure gauge 108 for the condensation section attached between the condenser 105*a* and an expansion valve 106 indicated a value of 1.6 MPa. The condensation temperature was about 60° C. Furthermore, the temperature of the heat sink 120*b* of the condenser 105*b* was 75°, which was higher than the condensation temperature and the temperature of the heat sink corresponding to the condenser 105 according to the first embodiment.

The print medium 101 was conveyed, by the heating and drying unit for the print medium including the heating section, from the refrigerant-outlet side of the heat sink 120*a*, corresponding to the condenser 105*a*, to the refrigerant-inlet side of the heat sink corresponding to the condenser 105*b*. The surface temperature on the print medium rose from 25° C. to 68° C. During conveyance on the heat sink corresponding to the condenser 105*a*, the print medium 101 was heated nearly to the condensation temperature. The temperature of the print medium 101 was further raised by conveying the print medium 101 on the heat sink corresponding to the condenser 105*b* at a temperature higher than that of the vicinity of the refrigerant inlet of the heat sink corresponding to the condenser 105*b* in the first embodiment. As a result, the surface temperature on the print medium was successfully further raised to a temperature that was 5° C. higher than that achieved according to the first embodiment. Furthermore, during the continuous conveyance of print media, the pressure indicated by the pressure gauge 108 for the condensation section attached between the condenser 105 and the expansion valve 106 was stably maintained at 1.6 MPa. The compressor 104 had a constant power consumption of 280 W.

As described above, in the heating and drying unit with the heating section using the heat pump as a heat source, when the temperature of the print medium printed with ink increases to a value equal to or greater than the condensation temperature of the refrigerant, the time required for drying can further be shortened. Furthermore, the efficiency of heat exchange with the heat sink is improved to reduce the insufficiency of heat dissipation, allowing a stable refrigeration cycle to be maintained. This enables the print medium to be heated and dried without excessively increasing the power consumption of the compressor, thus further improving an energy saving effect. In recent years, the heating temperature of the heat pump has been able to be increased by a $CO^2$ refrigerant that is available at high temperature. The use of the $CO^2$ refrigerant enables a further reduction in drying time.

In the present embodiment, the heat sink of the condenser is separated into two portions. However, the present invention is not limited to this configuration. The heat sink of the condenser may be separated into three or more portions. Subdividing the hotter heat sink of the condenser reduces a variation in the temperature of the refrigerant passing through each heat sink. The temperature in the heat sink is made uniform to restrain the temperature of the hotter heat sink from lowering. Therefore, the temperature of the refrigerant-inlet side can further be restrained from lowering, enabling the heat sink on the inlet side of the condenser to be maintained at a higher temperature.

In the above-described embodiments, the ink jet printing apparatus is of the full line type using print heads extending all over the print medium in the width direction thereof. However, the present invention is not limited to this configuration. An ink jet printing apparatus of what is called, a serial-scan type may be used in which an image is printed on the print medium by moving print heads in a main scanning direction and conveying the print medium in a sub-scanning direction.

Furthermore, in the specification, the term "printing" is used not only where meaningful information such as characters and figures is formed, but is also used regardless of whether the resultant object is meaningful or meaningless. The term "printing" also broadly represents formation of an image, a pattern, or the like on a print medium or processing of the print medium regardless of whether the resultant object is actualized so as to be visually perceived by human beings.

In addition, the term "printing apparatus" includes apparatuses with a print function such as a printer, a printer combined machine, a copier, and a facsimile machine, and a manufacturing apparatuses for manufacturing articles using the ink jet technique.

Additionally, the term "print medium" is not limited to paper used for common printing apparatuses but also broadly represents media that can receive ink, such as a cloth, a plastic film, a metal plate, glass, ceramics, wood, and leather.

Moreover, the term "ink" (also referred to as a "liquid") should be broadly interpreted as is the case with the above-described definition of the term "printing". The term "ink" represents a liquid which forms an image, a pattern, or the like on a print medium or processes the print medium when applied onto the print medium or which is used to treat the ink (for example, to solidify or insolubilize a coloring material in the ink applied to the print medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-035801, filed Feb. 22, 2011, which is hereby incorporated by reference herein in its entirety.

What is claimed is:

1. A printing apparatus comprising:

a print head configured to eject ink onto a print medium;

a heating unit configured to heat the print medium onto which the print head has ejected ink, the heating unit includes a heat-pump mechanism with a channel through which a refrigerant passes, and a conveying unit configured to convey the print medium downstream along a conveying direction, wherein the heat-pump mechanism comprises a compressor, a condenser, an expansion valve, and an evaporator each provided along the channel, the heating unit heating the print medium by transferring heat generated by the condenser when the refrigerant is condensed by the condenser, and the refrigerant in the channel flowing into the condenser at a downstream side thereof in the conveying direction and out from the condenser at an upstream side thereof in the conveying direction.

2. The printing apparatus according to claim 1, wherein the condenser is separated into at least two portions along the conveying direction.

3. The printing apparatus according to claim 2, wherein the condenser is separated into two portions, and one of the two portions which is located downstream of the other portion in the conveying direction of the print medium has a smaller thermal capacity than the other portion.

4. The printing apparatus according to claim 1, further comprising a temperature-measuring unit configured to measure the temperature of the condenser, and a control unit configured to control the compressor based on an output of the temperature-measuring unit, in such a manner that the temperature of the condenser at the downstream side thereof is higher than the condensing temperature of the refrigerant.

5. The printing apparatus according to claim 1, wherein the channel in the condenser is arranged in a meandering configuration.

* * * * *